United States Patent [19]

Nametkin et al.

[11] 4,166,025

[45] Aug. 28, 1979

[54] PROCESS FOR PURIFYING AROMATIC HYDROCARBONS

[76] Inventors: Nikolai S. Nametkin, Leninsky prospekt, 13, kv. 11; Viktor V. Fedorov, 3 Samotechny pereulok, 23, kv. 88; Evgeny A. Feigin, 3 Frunzenskaya ulitsa, 6, kv. 16; Ruf A. Kalinenko, Prospekt Mira, 124, korpus 13, kv. 375; Ilya R. Cherny, Zubovsky bulvar, 31/33, kv. 1; Jury N. Bocharov, ulitsa Dokukina, 3, korpus 1, kv. 13, all of Moscow, U.S.S.R.; Vladimir B. Titov, deceased, late of Moscow, U.S.S.R.; by Ljudmila A. Chervoneva, administratrix, ulitsa Udaltsova, 4, kv. 205, Moscow, U.S.S.R.

[21] Appl. No.: 610,897

[22] Filed: Sep. 5, 1975

Related U.S. Application Data

[63] Continuation of Ser. No. 498,848, Aug. 16, 1974, abandoned.

[30] Foreign Application Priority Data

Aug. 22, 1973 [SU] U.S.S.R. ..... 1954085

[51] Int. Cl.[2] ..... C10G 9/28; C10G 9/44

[52] U.S. Cl. ..... 208/126; 208/128; 208/130; 585/486; 585/807; 585/867; 585/901

[58] Field of Search ..... 208/125, 128, 130, 126; 260/674 R, 672 R, 672 NC

[56] References Cited

U.S. PATENT DOCUMENTS

| | | | |
|---|---|---|---|
| 2,852,440 | 9/1958 | Smith et al. | 208/75 |
| 3,310,592 | 3/1967 | Fukuda et al. | 208/57 |
| 3,542,667 | 11/1970 | McMahon et al. | 208/66 |
| 3,617,497 | 11/1971 | Bryson et al. | 208/128 |
| 3,754,045 | 8/1973 | Ehrlich et al. | 260/672 NC |
| 3,830,853 | 8/1974 | Khcheian et al. | 260/672 NC |
| 3,855,339 | 12/1974 | Hosoi et al. | 208/128 |

*Primary Examiner*—Herbert Levine

*Attorney, Agent, or Firm*—Holman & Stern

[57] ABSTRACT

A process for purifying aromatic hydrocarbons contained in liquid products of refining petroleum fractions or liquid products of coal coking or low-temperature carbonization from non-aromatic hydrocarbons which comprises heat-treatment of said liquid products at a temperature ranging from 750° to 950° C. under a pressure within the range of from 1 to 10 atm in the presence of acyclic $C_2$–$C_4$ hydrocarbons employed separately or in various combinations at a weight ratio between said acyclic hydrocarbons and said liquid products being of at least 0.3. The heat-treatment results in a vapor-gas mixture which is cooled to isolate a condensate containing predominantly aromatic hydrocarbons. The process is technologically simple and makes it possible to purify aromatic hydrocarbons practically without decomposition thereof.

12 Claims, No Drawings

PROCESS FOR PURIFYING AROMATIC HYDROCARBONS

This is a continuation of application Ser. No. 498,848 filed Aug. 16, 1974, now abandoned.

The present invention relates to processes for purifying aromatic hydrocarbons contained in liquid products of refining of petroleum fractions or liquid products of coal coking or low-temperature carbonization.

Said aromatic hydrocarbons comprise a starting feedstock for the production of heavy organic synthesis products. Thus, benzene is the starting material for the production of phenyl, cyclohexane, maleic anhydride, and benzene chloroderivatives; xylene and naphthalene are employed for the production of phthalic anhydride, terephthalic and isophthalic acids; ethylbenzene is employed for the production of styrene; indene and styrene serve as starting materials for the production of valuable polymeric products.

Aromatic hydrocarbons are incorporated in liquid products of refining petroleum fractions and liquid products of coal coking and low-temperature carbonization. Said liquid products contain a substantial amount of non-aromatic compounds such as paraffin, iso-paraffin, olefine, diene, and naphthene hydrocarbons. Thus, platforming of various petroleum feedstocks results in liquid products incorporating, in addition to aromatic hydrocarbons, paraffin, isoparaffin, and naphthene hydrocarbons. Pyrolysis of a petroleum feedstock also gives liquid products referred to, for example, as a pyro-condensate. The latter incorporates aromatic hydrocarbons, naphthene, olefine and diene hydrocarbons with the content of non-aromatic hydrocarbons in the pyrocondensate exceeding 40% by weight. Liquid products of coal coking and low temperature carbonization contain aromatic hydrocarbons with small amounts of olefine, diene, naphthene hydrocarbons and oxygen- and nitrogen-containing derivatives thereof. Purification of aromatic hydrocarbons produced in said processes cannot be effected by conventional rectification methods, since the boiling temperatures of numerous non-aromatic hydrocarbons insignificantly differ from those of aromatic hydrocarbons. The use of other separation methods such as extraction also results in substantial difficulties.

A commercial process for purifying aromatic hydrocarbons contained in petroleum pyrolysis products from non-aromatic hydrocarbons is known in the art. The process contemplates the use of a three-stage hydrogenation of non-aromatic hydrocarbons. As a hydrogenation agent, use is made of a hydrogen-containing gas. At the first stage diene hydrocarbons are catalytically hydrogenated to olefine and paraffin hydrocarbons at temperatures amounting to 250° C. under a pressure ranging from 10 to 80 atm. At the second stage olefine hydrocarbons and sulphur-containing products are catalytically hydrogenated at a temperature within the range of from 300° to 450° C. As a result of the two-stage hydrogenation, olefine and diene hydrocarbons are converted to saturated hydrocarbons. At the third stage two reactions are combined, viz. hydrocracking of saturated non-aromatic hydrocarbons to methane and ethane, and hydrodealkylation of aromatic hydrocarbons to benzene. These reactions are conducted at a temperature ranging from 500° to 850° C. under a pressure of from 10 to 60 atm. The resulting mixture is cooled and gaseous products are separated from liquid ones. The latter products are delivered to isolation of benzene.

According to this purification process only benzene is recovered among all aromatic hydrocarbons, while other valuable aromatic hydrocarbons such as styrene and indene are decomposed. As far as non-aromatic hydrocarbons are concerned, the process makes it possible to produce less valuable compounds such as methane and ethane. This prior art process has some other disadvantages residing in a rather complicated technology, difficult process control, the usejof high pressure, and increased consumption of relatively expensive hydrogen.

Also known in the art is another process for purifying aromatic hydrocarbons. The process is applicable to the purification of crude benzene contained in liquid products of coal coking. The process comprises admission of said liquid products into a movable bed of an inert heat-transfer medium and heat-treatment at a temperature withinthe range of from 600° to 950° C., preferably within the range of from 750° to 850° C., under atmospheric or elevated (up to 10 atm) pressure. The heat-treatment is effected in the presence of a hydrogenating agent such as hydrogen or a gas containing at least 30% free hydrogen. Molar ratio between hydrogen and benzene is maintained within the range of from 1.5 to 3. The above-mentioned bed of a heat-transfer medium may be fluidized or movable under gravity forces; it may comprise, for example, particles of coke, ceramics or other suitable inert materials of a 1.5 to 2.0 mm size. Use may be made, in particular, of an ascending or descending flow of such particles. A vapour-gas mixture resulting from the heat-treatment is cooled to give a benzene-containing condensate. Benzene is recovered therefrom by conventional techniques.

A principal reaction in this process ensuring purification of benzene from non-aromatic hydrocarbons is the reaction of hydrocracking of non-aromatic hydrocarbons resulting in the formation of less important products, viz. methane and ethane. All other valuable aromatic products, except benzene, are decomposed under the process conditions. The process requires circulation of great amounts of hydrogen. Among disadvantages of the process an unfavourable thermal balance should be mentioned: since hydrocracking reactions are exothermal, then at a high content of non-aromatic hydrocarbons (over 10% by weight) the process is unstable and very sensitive to temperature variations and feed supply rates which makes the process control rather complicated.

It is an object of the present invention to provide such a process for purifying aromatic hydrocarbons which would ensure retaining valuable aromatic hydrocarbons.

It is another object of the invention to simplify the process technology.

These and other objects are accomplished in accordance with the present invention by providing a process for purifying aromatic hydrocarbons contained in liquid products of refining petroleum fractions or liquid products of coal coking and low-temperature carbonization from non-aromatic hydrocarbons by way of heat-treatment of said liquid products at a temperature within the range of from 750° to 950° C. under a pressure of from 1 to 10 atm, followed by cooling the resulting vapour-gas mixture and isolation of a condensate containing aromatic hydrocarbons. The heat-treatment according to the present invention is effected in the presence of acyclic $C_2$–$C_4$ hydrocarbons employed either separately or in various combinations at a weight ratio between said acyclic hydrocarbons and said liquid products of at least 0.3.

The aromatic hydrocarbons to be purified may be, as it has been mentioned hereinbefore, of a different origin. The process of the present invention makes it possible to purify aromatic hydrocarbons contained in liquid products of pyrolysis of commercial hydrocarbon fractions such as pyro-condensate. Also suitable for the purification according to the process of the present invention are aromatic hydrocarbons contained in the products of catalytical treatment of petroleum fractions, for example those of platforming. Liquid products of coal coking or low-temperature carbonization may be also successfully treated by the process of the present invention.

The principal idea of the present invention resides in the conversion of the starting mixture of liquid products containing aromatic and non-aromatic hydrocarbons with proximate boiling temperatures into a mixture consisting of only aromatic hydrocarbons with sharply different boiling temperatures. Separation of such mixture into individual components may be effected quite simply by using conventional methods, for example rectification. Formation of a mixture containing aromatic hydrocarbons only is ensured due to the fact that the heat-treatment of said liquid products at given temperatures and pressures is effected in the presence of acyclic $C_2$–$C_4$ hydrocarbons. The main reaction proceeding under these conditions is the reaction of decomposition of non-aromatic hydrocarbons to gaseous products with all aromatic hydrocarbons present in the starting feed such as styrene and indene remaining unchanged. The decomposition rate of the non-aromatic hydrocarbons depends on selected temperatures, pressure and weight ratio of the acyclic $C_2$–$C_4$ hydrocarbons to said liquid products. The weight ratio should be at least 0.3. At a lower value the effect of acyclic hydrocarbons becomes less pronounced. At greater values of the ratio the purification process is facilitated. The upper limit of the ratio is defined by purely economic considerations. Parallel to decomposition reactions of non-aromatic hydrocarbons, there also occur reactions of hydrodealkylation of alkylaromatic hydrocarbons and reactions of the formation of valuable products such as styrene, methylstyrene, indene, methylindene, naphthalene. Reactions of coke-formation, formation of higher aromatic hydrocarbons such as diphenyl, methyldiphenyl, dimethyldiphenyl occur but to an insignificant extent. The content of diphenyl, methyldiphenyl, and dimethyldiphenyl in the condensate does not exceed the content of the same hydrocarbons in the case of a one-stage heat-treatment in the presence of hydrogen. It has been found that decomposition rate of non-aromatic hydrocarbons is considerably superior to the rate of other reactions occurring under these conditions.

As the acyclic $C_2$–$C_4$ hydrocarbons it is advisable to use ethane, propane, butane, butene-1; use may be also made of propylene and isobutylene which, however, results in an increased coke-formation. Said compounds may be used both separately and in various combinations; this latter condition especially relates to propylene and isobutylene.

In order to reduce the coke-formation, the heat-treatment of liquid products should be preferably effected in the presence of inert diluents such as steam, nitrogen, and argon.

To increase the heating rte of the starting liquid products at the stage of heat-treatment, heat-transfer media in any physical state may be used. Some examples of such heat transfer media are steam, coke, sand.

In some cases, the condensate may contain cyclopentadiene. In such cases, in order to separate cyclopentadiene from aromatic hydrocarbons in the condensate, use is made of a distillation operation.

An essential advantage of the process according to the present invention resides in the possibility of purifying aromatic hydrocarbons incorporated in liquid products of refining petroleum fractions and liquid products of coal coking and low temperature carbonization from non-aromatic hydrocarbons, while ensuring the retention, in said liquid products, of such valuable aromatic hydrocarbons as styrene, indene, and the like. The purification of aromatic hydrocarbons contained in liquid products of coal coking and low-temperature carbonization, is accompanied, to a considerable extent, by a purification from oxygen- and nitrogen-containing derivatives of the hydrocarbons. Furthermore, in the process of the present invention there are formed such valuable products as lower olefines and divinyl resulting from the heat-treatment of said liquid products in the presence of the acyclic hydrocarbons. An advantage of the process of the present invention resides also in the fact that under the process conditions there occur endothermal reactions of decomposition of non-aromatic hydrocarbons and exothermal reactions of hydrodealkylation of alkylaromatic hydrocarbons such as xylenes, ethylbenzene, toluene. As a consequence, the total heat balance of the reactions proceeding is close to the thermo-neutral heat balance, whereby the process control is considerably facilitated. Moreover, the process does not require the use of catalysts and circulation of great amounts of relatively expensive hydrogen. All this results in a substantially simplified process scheme.

The process for purifying aromatic hydrocarbons according to the present invention is effected in the manner as follows.

The starting liquid products containing aromatic and non-aromatic hydrocarbons are delivered with or without an inert diluent, into a reactor which is charged with acyclic $C_2$–$C_4$ hydrocarbons employed either separately or in various combinations preheated to a temperature ranging from 500° to 650° C. To ensure a rapid heat supply for the process, the reactor may be fed with a heat-transfer medium heated to a temperature exceeding the temperature of the heat-treatment of said liquid products (750°–950° C.). The process is conducted under a pressure ranging from 1 to 10 atm and at a weight ratio of the acyclic $C_2$–$C_4$ hydrocarbons to said liquid products of at least 0.3.

The heat treatment may be effected in different type reactors such as a tubular reactor, reactor with a fluidized bed of a heat-transfer medium or with a descending flow of the latter. In the tubular type reactors the heat-transfer medium may be, for example, steam. In reactors with a fluidized bed or descending flow, the heat-transfer medium may be, for example, sand or coke.

The vapour-gas mixture resulting from the heat-treatment is discharged from the reactor, cooled and delivered to a separator. In the separator gaseous products are separated from the condensate.

When required, individual aromatic hydrocarbons may be isolated from the condensate by conventional techniques. Less important higher aromatic hydrocarbons such as diphenyl, methyldiphenyl, dimethyldiphenyl, may be recycled to the stage of the heat-treatment by way of intermixing thereof with the starting liquid products. Since the formation of diphenyl, methyldiphenyl and dimethyldiphenyl under the purification conditions is a reversible reaction, recycling thereof to the heat-treatment stage eliminates their additional formation from the starting liquid products.

In cases where cyclopentadiene is contained in the condensate, it may be removed therefrom by way of distillation.

Unreacted acyclic hydrocarbons contained in the gaseous products may be also recycled, after separation thereof, back to the heat-treatment stage by intermixing them with the acyclic hydrocarbons supplied into the reactor.

For better understanding of the present invention the following specific Examples are given hereinbelow.

EXAMPLE 1

Into a reactor with a fluidized bed of a heat-transfer medium made of a sand, ethane pre-heated to 650° C. is supplied. Also fed into the reactor is a mixture of liquid products of pyrolysis of a straight-run gasoline with an inert diluent, viz. steam at the weight ratio of 1:0.5 respectively. Composition of the starting products is given in Table 1 hereinbelow.

Table 1

| Composition of the starting liquid products of straight-run gasoline pyrolysis, wt.% | |
|---|---|
| Non-aromatic hydrocarbons: | |
| $C_3$ $C_4$ olefines | 0.5 |
| Acyclic olefines and $C_5$ dienes | 1.84 |
| Cyclopentadiene | 2.14 |
| Acyclic olefines and $C_6$ dienes | 5.11 |
| Methylcyclopentadiene | 2.54 |
| Cyclohexane | 2.91 |
| Olefines and dienes $C_7$ | 13.95 |
| Olefines and dienes $C_8$ | 9.5 |
| Olefines and dienes $C_9$ | 0.58 |
| Olefines and dienes $C_{10}$ | 0.82 |
| Total, non-aromatic hydrocarbons | 40.14 |
| Aromatic hydrocarbons: | |
| Benzene | 22.34 |
| Toluene | 18.44 |
| Ethylbenzene | 2.44 |
| Xylenes | 4.29 |
| Isopropylbenzene | 0.75 |
| Styrene | 3.77 |
| Methylstyrene | 2.71 |
| Indene | 1.51 |
| Methylindenes | 0.88 |
| Naphthalene | 2.76 |
| TOTAL, aromatic hydrocarbons: | 59.86 |

The heat-treatment is effected under isothermal conditions at the temperature of 850° C., 1 atm pressure and at the weight ratio of 1:1 between ethane and the liquid products. The vapour-gas mixture resulting from the heat-treatment is cooled and aromatic hydrocarbons are separated in a separator as a condensate from gaseous products. Cyclopentadiene is separated from the condensate by distillation. The condensate composition after removal of cyclopentadiene and the composition of gaseous products ncluding cyclopentadiene are given in Table 5 following the Examples.

EXAMPLE 2

Into a tubular reactor propane heated to 600° C. and liquid products of straight-run gasoline pyrolysis are fed. The composition of the starting liquid products is given in Table 1 hereinabove. Steam heated to 950° C. is also fed into the reactor as a heat-transfer medium. Heat-treatment is effected at a temperature ranging from 800° to 840° C., 3 atm pressure and at the weight ratio between propane and liquid products of 1.4. Vapour-gas mixture resulting from the heat-treatment is cooled and aromatic hydrocarbons are separated in a separator from the gaseous products as a condensate. Cyclopentadiene is distilled off. Condensate composition after the removal of cyclopentadiene and composition of gaseous products including cyclopentadiene are given in Table 5 hereinbelow.

EXAMPLE 3

Into a tubular reactor, ethane heated to 650° C. is fed. Also fed into the reactor are liquid products of pyrolysis of straight-run gasoline. Argon is fed into the reactor at the weight ratio of 1:1 between argon and liquid products. Composition of the starting liquid products is given in the following Table 2.

Table 2

| Composition of the starting liquid products of straight-run gasoline pyrolysis, wt.% | |
|---|---|
| Non-aromatic hydrocarbons | |
| Acyclic olefines and dienes $C_5$ | 3.65 |
| Cyclopentadiene | 2.89 |
| Acyclic olefines and dienes $C_6$ | 2.60 |
| Methylcyclopentadiene | 2.98 |
| Cyclohexane | 0.33 |
| Olefines and dienes $C_7$ | 0.30 |
| TOTAL, non-aromatic hydrocarbons | 12.75 |
| Aromatic hydrocarbons | |
| Benzene | 46.88 |
| Toluene | 24.02 |
| Ethylbenzene | 1.25 |
| Xylenes | 2.57 |
| Styrene | 4.04 |
| Methylstyrene | 1.13 |
| Indene | 2.00 |
| Methylindene | 0.92 |
| Naphthalene | 4.44 |
| TOTAL, aromatic hydrocarbons | 87.25 |

The heat-treatment is conducted at a temperature ranging from 750° to 840° C., 1 atm pressure and at the weight ratio of 0.3 between ethane and liquid products. Gaseous mixture resulting from the heat-treatment is cooled and aromatic hydrocarbons are separated in a separator as a condensate from the gaseous products. Condensate composition and composition of the gaseous products are given in Table 5.

EXAMPLE 4

Into a tubular reactor butane is fed, heated to 500° C. Liquid products of straight-run gasoline pyrolysis are also fed into the reactor. Nitrogen, as an inert diluent, is fed into the reactor at the weight ratio to liquid products of 1.2. The starting liquid products have the composition shown in Table 2. Heat-treatment is conducted at a temperature ranging from 750° to 840° C., 1 atm pressure and at the weight ratio between butane and liquid products of 3.3. Vapour-gas mixture resulting from the heat-treatment is cooled and aromatic hydrocarbons are separated in a separator as a condensate from the gaseous products. Condensate composition as well as composition of the gaseous products are given in Table 5.

EXAMPLE 5

Into a top portion of a reactor with a descending flow of a heat-transfer medium of coke, ethane heated to 650° C. is fed. Also delivered into the reactor are liquid products of pyrolysis of straight-run gasoline with the composition shown in Table 2 hereinabove. Heat-treatment is effected at the heat-transfer medium temperature of 950° C. at the top portion of the reactor and at 850° C.—at the bottom portion. The process is conducted under 1 atm pressure at the weight ratio between ethane and the liquid products of 3.8. Vapour-gas mixture resulting from the heat-treatment is cooled and aromatic hydrocarbons are separated in a separator as a condensate from the gaseous products. Condensate composition as well as the composition of gaseous products is given in Table 5.

EXAMPLE 6

Into a top portion of a reactor with a descending flow of a heat-transfer medium of coke, a mixture is fed consisting of 85 vol.% of ethane and 15 vol.% of butane and heated to 650° C. Also fed into the reactor are liquid products of coal low temperature carbonization with the composition given in Table 3. Heat-treatment is effected at the heat-transfer medium temperature of 930° C. at the top section of the reactor and at 850° C.—at the bottom section thereof. Vapour-gas mixture resulting from the heat-treatment effected under 1 atm pressure at the weight ratio between the mixture (ethane-butane) and the liquid products of 3.0 is cooled and purified and aromatic hydrocarbons are separated in a separator as a condensate from gaseous products. Condensate composition is given in Table 5.

EXAMPLE 7

Ethane heated to 650° C. is fed into a tubular reactor. Also fed into the reactor is a mixture of liquid products of coal low temperature carbonization with an inert diluent, namely, steam at the weight ratio between the liquid products and steam of 2.0. Composition of the liquid products is shown in Table 3.

Table 3

| Composition of the starting liquid products of coal low temperature carbonization, wt.% | |
|---|---|
| Olefines and dienes $C_5$ | 0.77 |
| Olefines and dienes $C_6$ | 0.68 |
| Benzene | 0.60 |
| Olefines and dienes $C_7$ | 4.13 |
| Toluene | 2.54 |
| Olefines and dienes $C_8$ | 1.50 |
| Ethylbenzene | 0.80 |
| Xylene | 4.86 |
| Styrene | 2.21 |
| Trimethylbenzenes | 1.28 |
| Indene | 9.70 |
| Methylindenes | 9.00 |
| Naphthalene | 5.38 |
| Methylnaphthalene | 7.12 |
| Unidentified aromatic hydrocarbons $C_9$—$C_{10}$ and nitrogen- and oxygen-containing compounds | 49.43 |
| TOTAL | 100.0 |

Heat-treatment is effected at a temperature ranging from 800° to 830° C. at the weight ratio of 2.2 between ethane and the liquid products under 1 atm pressure. Vapour-gas mixture resulting from the heat-treatment is cooled and purified and aromatic products are separated in a separator from the gaseous products in the form of a condensate. The condensate composition as well as that of the gaseous products are given in Table 5 hereinbelow.

EXAMPLE 8

Into a tubular reactor a mixture is fed consisting of 85 vol.% of ethane and 15 vol.% of butane and heated to 600° C. Also fed into the reactor are liquid gasoline plat-forming products. Composition of the liquid products is given in Table 4. Heat-treatment is conducted at a temperature within the range of from 800° to 830° C. under 10 atm pressure and at the weight ratio between the mixture (ethane-butane) and the liquid products of 2.0. Vapour-gas mixture resulting from the heat-treatment is cooled and purified and aromatic hydrocarbons are separated in a separator from the gaseous products in the form of a condensate. Condensate composition as well as that of the gaseous products are given in Table 5.

The composition of purified aromatic hydrocarbons is determined by methods of chromatography using an ionization-flame detector with programmed column heating to 150° C. Squalane is used as the stationary phase, while the gas-carrier is argon. Composition of gaseous products is determined in a similar manner with the exception that diisononylphthalate is used as the stationary phase at room temperature. Methane and hydrogen are also determined by chromatography using a katharometer (thermal conductivity cell) as a detector. A modified alumina is used as the stationary phase at the temperature of 40° C.

Table 4

| Composition of the starting liquid products of gasoline platforming, wt.% | |
|---|---|
| Non-aromatic hydrocarbons: | |
| Propane, butane | 3.59 |
| Pentane + isopentane | 12.13 |
| n-Hexane + isohexanes | 15.53 |
| Methylcyclopentane | 1.52 |
| Cyclohexane | 6.59 |
| Methylcyclohexane | 5.56 |
| n-Heptane + isoheptanes | 3.65 |
| n-Octane + isooctanes | 6.75 |
| TOTAL, non-aromatic hydrocarbons: | 55.32 |
| Armoatic hydrocarbons | |
| Benzene | 4.53 |
| Toluene | 15.11 |
| Ethylbenzene | 2.85 |
| Xylenes | 9.84 |
| Trimethylbenzenes | 3.03 |
| Indene | 4.69 |
| Methylindenes | 4.63 |
| TOTAL, aromatic hydrocarbons: | 44.68 |

Table 5

| Condensate composition, wt.% and composition of gaseous products, vol.% | | | | | | | | |
|---|---|---|---|---|---|---|---|---|
| Condensate components, wt.% | Example No. | | | | | | | |
| | 1 | 2 | 3 | 4 | 5 | 6 | 7 | 8 |
| Benzene | 50.57 | 40.93 | 49.00 | 40.45 | 80.10 | 5.08 | 10.66 | 6.65 |

Table 5-continued

| Condensate components, wt.% | Condensate composition, wt.% and composition of gaseous products, vol.% Example No. 1 | 2 | 3 | 4 | 5 | 6 | 7 | 8 |
|---|---|---|---|---|---|---|---|---|
| Toluene | 22.10 | 19.94 | 20.67 | 12.30 | 5.20 | 6.32 | 9.22 | 20.68 |
| Ethylbenzene | 0.50 | — | 0.35 | 1.36 | 0.10 | — | 5.27 | 3.29 |
| Xylene | 3.52 | 3.86 | 3.42 | 2.41 | 0.38 | 4.73 | 7.11 | 23.75 |
| Isopropylbenzene | — | 0.79 | — | — | — | — | — | 9.42 |
| Styrene | 9.32 | 8.30 | 8.31 | 16.89 | 4.20 | 4.58 | 1.91 | 10.77 |
| Methylstyrene | 1.42 | 3.20 | 5.52 | 3.52 | 0.41 | 5.94 | 7.27 | 19.42 |
| Indene | 2.66 | 4.61 | 1.50 | 4.80 | 2.07 | 10.07 | 10.01 | 1.35 |
| Methylindenes | 1.47 | 1.29 | 2.61 | 4.15 | 0.22 | 4.17 | 7.39 | 2.27 |
| Naphthalene | 4.00 | 12.00 | 6.62 | 8.20 | 4.20 | 38.31 | 32.78 | 20.6 |
| Methylnaphthalenes | 1.76 | 2.00 | — | 1.72 | 1.09 | 2.06 | 5.30 | — |
| Diphenyl + higher aromatics | 2.68 | 3.08 | 2.00 | 4.20 | 2.03 | 5.83 | 3.08 | 0.36 |
| TOTAL: | 100.00 | 100.00 | 100.00 | 100.00 | 100.00 | 100.00 | 100.00 | 100.00 |
| Gaseous products components, vol.%: | | | | | | | | |
| Hydrogen | 28.36 | 12.58 | 27.48 | 22.14 | 44.50 | 13.75 | 30.40 | 11.58 |
| Methane | 15.85 | 22.85 | 12.12 | 40.98 | 9.53 | 18.71 | 10.80 | 14.00 |
| Ethane | 20.66 | 2.41 | 28.34 | 3.54 | 9.85 | 24.24 | 30.41 | 33.13 |
| Ethylene | 32.60 | 27.69 | 29.55 | 18.18 | 33.75 | 38.65 | 26.48 | 33.50 |
| Propane | — | 13.73 | — | 0.20 | — | 0.23 | 0.23 | 0.12 |
| Propylene | 1.13 | 17.60 | 1.18 | 10.46 | 0.34 | 2.53 | 1.01 | 5.57 |
| Putane | — | — | 0.62 | 3.00 | 0.73 | 0.44 | — | 1.57 |
| Divinyl | 0.90 | 2.04 | 0.71 | 1.50 | 1.30 | 1.45 | 0.08 | 0.53 |
| Cyclopentadiene | 0.50 | 1.10 | — | — | — | — | — | — |
| TOTAL: | 100.00 | 100.00 | 100.00 | 100.00 | 100.00 | 100.00 | 100.00 | 100.00 |

What is claimed is:

1. A process for purifying aromatic hydrocarbons contained in products selected from the group consisting of liquid products of refining petroleum fractions and liquid products of coal coking and low-temperature carbonization from non-aromatic hydrocarbons which comprises heat-treating said liquid products at a temperature ranging from 750° to 950° C. under a pressure of from 1 to 10 atm in the presence of a compound selected from the group consisting of acyclic $C_2$–$C_4$ hydrocarbons at a weight ratio of the acyclic hydrocarbons to said liquid products of at least 0.3, forming a vapor-gas mixture; cooling said mixture to isolate a condensate containing predominantly aromatic hydrocarbons.

2. A process as claimed in claim 1, wherein the acyclic $C_2$–$C_4$ hydrocarbon is selected from the group consisting of ethane, propane, butane, butene-1, propylene, and isobutylene.

3. The process as claimed in claim 1, wherein the heat treatment of said liquid products is effected in the presence of an inert diluent agent selected from the group consisting of steam, nitrogen, and argon.

4. The process as claimed in claim 1, wherein the heat treatment of said liquid products is effected in the presence of an inert heat-transfer agent selected from the group consisting of sand, coke, and steam.

5. The process as claimed in claim 1, wherein the heat treatment of said liquid products is effected in the presence of an inert diluent agent selected from the group consisting of steam, nitrogen, and argon, and an inert heat-transfer agent selected from the group consisting of sand, coke, and steam.

6. A process as claimed in claim 3, wherein the inert diluent agent is steam.

7. A process as claimed in claim 3, wherein the inert diluent agent is nitrogen.

8. A process as claimed in claim 3, wherein the inert diluent agent is argon.

9. A process as claimed in claim 4, wherein the heat-transfer agent is a sand.

10. A process as claimed in claim 4, wherein the heat-transfer agent is a coke.

11. A process as claimed in claim 4, wherein the heat-transfer agent is steam.

12. A process as claimed in claim 1, wherein cyclopentadiene is separated from the condensate by distillation.

* * * * *